United States Patent [19]

Movshovich et al.

[11] 4,058,960

[45] Nov. 22, 1977

[54] DISTRIBUTING DEVICE FOR SUPPLYING COMPRESSED AIR TO CHAMBERS OF APPARATUS FOR MAKING SELF-TWISTED PRODUCT

[76] Inventors: Pavel Mikhailovich Movshovich, Pechatnikov pereulok, 3, kv. 8, Moscow; Viktor Pavlovich Khavkin, ulitsa Vatutina, 11, kv. 4, Moskovskaya oblast, Khimki; Gennady Konstantinovich Maximov, Kaspiiskaya ulitsa, 20, korpus 3, kv. 137, Moscow; Natalya Borisovna Babushkina, Chasovaya ulitsa, 5b, kv. 15, Moscow; Alexandr Anatolievich Baranov, Proletarsky prospekt, 62, korpus 1, kv. 38, Moscow; Lev Nikolaevich Ivanov, Kotelnicheskaya naberezhnaya, 25/8, kv. 74, Moscow; Sergei Vladimirovich Nezelenov, Kineshemskoe shosse, 8[a], kv. 6, Kostroma; Gennady Nikolaevich Shutov, ulitsa Sovetskaya, 119, kv. 101, Kostroma; Leonid Nikiforovich Tsygulev, Prospekt textilschikov, 94[a], kv. 103, Kostroma; Vadim Sergeevich Ilin, ulitsa 8 Okruzhnaya, 11, kv. 11, Kostroma, all of U.S.S.R.

[21] Appl. No.: 715,166

[22] Filed: Aug. 17, 1976

[51] Int. Cl.[2] ..... D01H 7/90

[52] U.S. Cl. ..... 57/34 AT; 57/77.3; 137/624.13; 137/625.11

[58] Field of Search ..... 57/34 R, 34 B, 34 AT, 57/77.3; 137/624.11, 624.13, 625.11

[56] References Cited

U.S. PATENT DOCUMENTS

| | | | |
|---|---|---|---|
| 3,509,709 | 5/1970 | Tsuruta et al. | 57/34 AT X |
| 3,937,252 | 2/1976 | Ishido | 137/624.13 |
| 3,951,321 | 4/1976 | Heusser | 57/77.3 X |

*Primary Examiner*—Jerry W. Myracle
*Assistant Examiner*—Charles Gorenstein
*Attorney, Agent, or Firm*—Steinberg & Blake

[57] ABSTRACT

A distributing device for supplying compressed air to the jet nozzles of swirl chambers relates to apparatus for making a self-twisted product. The distributing device comprises a stationary hollow housing with apertures and a passageway for supplying compressed air, and also a rotary distributing member of a cylindrical shape, in the form of a sleeve with a bottom, mounted in the internal space of the housing with a gap left therebetween, this gap permanently communicating with the compressed air supply passageway. The open end of the distributing member faces the compressed air supply passageway and, the member having passages made in the cylindrical wall thereof, periodically communicating through the apertures in the housing with the jet nozzles of the swirl chambers, to supply compressed air thereinto. The disclosed structure of the distributing device enables to increase the reliability of its performance and to provide for the stability of the flow of the process of obtaining the self-twisted product.

5 Claims, 2 Drawing Figures

DISTRIBUTING DEVICE FOR SUPPLYING COMPRESSED AIR TO CHAMBERS OF APPARATUS FOR MAKING SELF-TWISTED PRODUCT

The invention relates to equipment for making a self-twisted product and, more particularly, it relates to distributing devices for supplying compressed air to the jet nozzles of the swirl chambers of apparatus for making a self-twisted product.

There is already known a distributing device for supplying compressed air to the nozzles of the swirl chambers, incorporated in an apparatus for making a self-twisted product.

In this known apparatus, the distributing device has a cylindrical distributing member shaped as a scroll rotatable in a stationary housing. The space left between the housing and the scroll serves as passages communicating with the jet nozzles of the swirl chambers via apertures made in the housing. For the scroll to close off reliably the apertures in the housing, which is essential for precluding the supply of compressed air to the jet nozzles of the swirl chambers within the passive period of operation of these nozzles, the surfaces of the scroll and of the housing have no gap left therebetween, i.e. they are ground-in or lapped to each other. Therefore, these surfaces wear away relatively rapidly in operation of the apparatus, which causes the appearance of an uncontrollable clearance between these surfaces, and this, in turn, changes the characteristics of the air swirl produced in the swirl chamber and acting upon a filamentary strand to twist the same. In this way, the reliability of operation of the distributing device is impaired, which affects the overall stability of the production process of forming the self-twisted product and the quality of the product itself.

It is an object of the present invention to provide a distributing device for supplying compressed air to the jet nozzles of the swirl chambers of an apparatus for making a self-twisted product, which should be of a structure providing for higher reliability of the operation of the distributing device and thus enhancing the stability of the overall production process of making the self-twisted product.

This and other objects are attained in a distributing device for supplying compressed air to the jet nozzles of the swirl chambers of an apparatus for making a self-twisted product, comprising a stationary hollow housing with a compressed air supply passageway, to supply compressed air to a cylindrical distributing member mounted in the housing and having passages periodically communicating in operation with the jet nozzles of the swirl chambers via apertures made in the housing, to supply compressed air to these jet nozzles, in which device, in accordance with the present invention, the cylindrical distributing member is mounted in the housing with a gap left therebetween, this gap permanently communicating with the compressed air supply passageway, the distributing member being in the form of a sleeve with a bottom, the passages adapted to communicate periodically with the jet nozzles of the swirl chambers being made in the cylindrical wall of the distributing member, this distributing member having its open end facing the compressed air supply passageway.

The provision of the positive gap between the stationary housing and the rotary cylindrical distributing member permanently communicating with the compressed air supply passageway precludes direct contact between the housing and the distributing member, whereby the reliability of the performance of the entire distributing device is significantly enhanced. Furthermore, the provision of this gap results in some degree of communication of the inoperative jet nozzle with the compressed air supply passage. Consequently, there is created a certain gauge pressure in the inoperative nozzle, adjustable by varying the size of the gap, which enables any directed flow of air to be precluded from an operative jet nozzle into the inoperative one, which, while not affecting the intensity of the air swirl, precludes clogging of the nozzles, in which way the stability of the production process is increased. Thus, it is expedient that the size of the gap should be selected to satisfy the condition that it should pass substantially less compressed air than any one of the passages of the distributing member.

It can be seen that the herein disclosed distributing device is of a simple structure, reliable in operation and enhances the stability of the overall production process of making a self-twisted product.

Given hereinbelow is a detailed description of an embodiment of a distributing device in accordance with the invention, with reference being had to the accompanying drawings, wherein.

Figure 1:
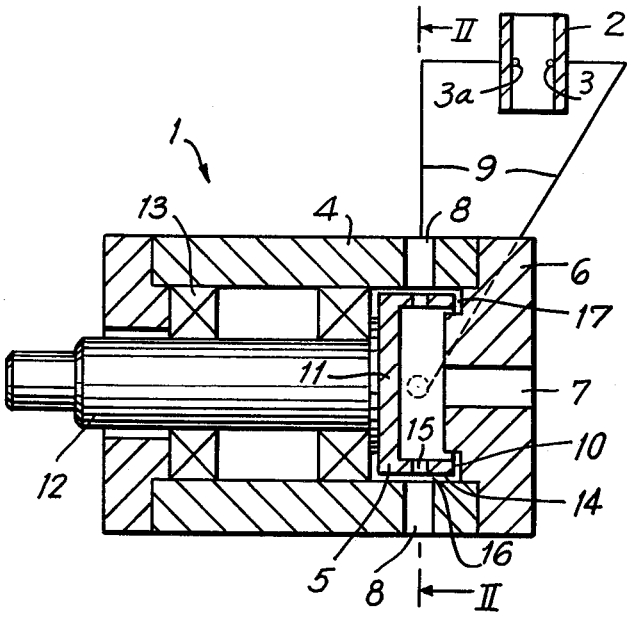
FIG. 1 is a schematical longitudinal sectional view of a distributing device with the swirl chambers.

Referring now to the drawings, the distributing device 1 (FIG. 1) constitutes one of the units of an apparatus for making a self-twisted product, the apparatus also including a plurality of swirl chambers 2 corresponding in number to the strands united to form the product. Each chamber 2 has at least two jet nozzles 3 adapted to alternately produce within this chamber air swirls of opposite directions, which act upon the strand passing through the chamber and impart thereto an alternating twist.

The distributing device 1 includes a stationary hollow housing 4 accommodating a rotary distributing member 5 in the form of a sleeve with a bottom. The end face of the housing 4, in the form of a lid 6, has made therethrough a passageway 7 for supplying compressed air from a source (not shown), while the side wall of the housing 4 has made therethrough a plurality of apertures 8, each communicating via a hose 9 with the respective jet nozzle 3 of the swirl chamber 2. The hoses 9 are schematically shown in FIG. 1 by a solid line.

This distributing member 5 in the form of a sleeve with a bottom has its open end 10 facing the compressed air supply passageway, while its bottom 11 is mounted on the end of a driven shaft 12 journalled in bearings 13 received in the internal space of the housing 4. The cylindrical wall 14 of the rotary distributing member 5 has made therethrough passages 15 which, with the distributing member rotating, communicate periodically via the apertures 8 in the housing 4 with the jet nozzles 3 of the swirl chambers 2, to supply compressed air thereto.

The distributing member 5 is mounted in the housing 4 so that there is left between the cylindrical side wall 14 of the distributing member 5 and the internal wall of the housing 4 an annular gap 16, and there is also provided a gap 17 between the open end 10 of the distributing member 5 and the lid 6 of the housing 4. Consequently, the gap 16 permanently communicates with the compressed air supply passageway 7, to supply compressed air via passages 15 and the gap 17, the gap 16 communicating via the apertures 8 in the housing 4 with the jet nozzles 3 of the swirl chambers 2. The size of the gap 16 is selected to satisfy the condition that it should pass substantially less compressed air than any one of the passages 15 of the distributing member 5, so as to create in the inoperative one of the nozzles some gauge pressure, preventing access of air and dust thereinto from the operative nozzle.

Figure 2:
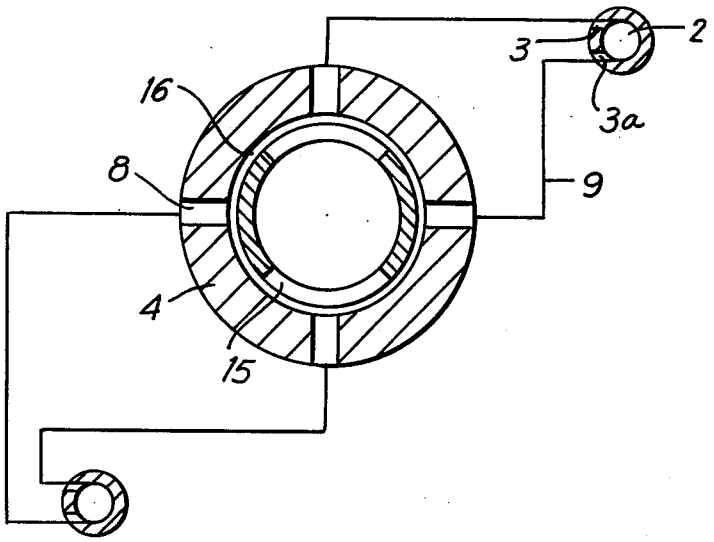
FIG. 2 is a sectional view taken along line II—II of FIG. 1.

The passages 15 of the distributing member 5 can be in the form of slots illustrated in FIG. 2, the shape and the dimensions of these grooves defining the law of the variation of the twisting action of the air swirl upon the strand in a chamber 2.

The herein disclosed distributing device operates as follows.

Via the supply passage 7 (FIG. 1) compressed air is directed into the internal space of the distributing member 5, wherefrom through that one of the passages 15 which at the moment communicates with the aperture 8 of the housing 4 compressed air is fed through a respective nozzle 3 into the swirl chamber 2. In this way, an air swirl of the first direction is produced within the the chamber 2. Meanwhile, the other, inoperative nozzle 3a of this chamber, i.e. the one which is not communicating with the passage 15 of the distributing member 5, communicates via the aperture 8 in the housing 4 with the gap 16, whereby there is created in this inoperative nozzle 3a a certain value of gauge pressure of the compressed air, substantially smaller than that within the passage 15. This precludes access of a directed air flow from the operating nozzle 3 into the inoperative one 3a, so that the intensity of the swirl is not affected, and the jet nozzles do not get clogged, which enhances the stability of the production process.

The number of the passages 15 of the distributing member 5 can be greater than that described hereinabove, this number being divisible by two. Then, to ensure the required frequency of the switching over of the direction of the air swirls in the chambers, the angular speed of the distributing member 5 is to be reduced the corresponding number of times. Furthermore, by varying the shape of the passage 15 it is possible to vary the pattern of the air pulse in the swirl chamber, while the duration of the action of this pulse upon the strand can be adjusted by varying the flow passage area of the passage 15.

An improved quality of the product, attainable, e.g. by phase-shifting the twists in the strands being united, can be provided for by arranging the passages 15 asymmetrically in the distributing member 5 (this arrangement is not shown in the drawings).

What is claimed is:

1. A distributing device for supplying compressed air to the jet nozzles of the swirl chambers of an apparatus for making a self-twisted product, comprising: a stationary hollow housing; a compressed air supply passageway in said housing; apertures in said housing and communicating with the jet nozzles of the swirl chambers; a rotary cylindrical distributing member accommodated in the internal space of said hollow housing; a gap defined between said housing and a cylindrical surface of said distributing member, permanently communicating with said compressed air supply passageway; said cylindrical distributing member being shaped as a sleeve with a bottom, a cylindrical wall and an open end facing said compressed air supply passageway; passages in the cylindrical wall of said distributing member, adapted, with said cylindrical distributing member rotating in operation, to communicate periodically with the jet nozzles of the swirl chambers through said apertures in said housing, to supply compressed air to the jet nozzles of the swirl chambers.

2. A distributing device as claimed in claim 1, wherein the size of said gap is selected to pass substantially less compressed air than any one of said passages of said distributing member.

3. A distributing device as claimed in claim 1, wherein said housing has an end in the form of a lid, said lid formed with said compressed air supply passageway and said cylindrical distributing member also defining a gap between said open thereof and said lid.

4. A distributing device as claimed in claim 1, wherein a driven shaft is connected to said bottom of said distributing member for rotating said distributing member.

5. A distributing device as claimed in claim 4, wherein said housing has an internal space, and bearings situated in said internal space and said driven shaft being journalled in said bearings.

* * * * *